United States Patent [19]

Evans

[11] 3,955,450

[45] *May 11, 1976

[54] ADJUSTABLE WRENCH FOR TORQUEING AND RATCHETING A SYMMETRICAL POLYGON MEMBER

[75] Inventor: James P. Evans, Oklahoma City, Okla.

[73] Assignees: James R. Head; Paul H. Johnson, both of Tulsa, Okla.

[ * ] Notice: The portion of the term of this patent subsequent to Nov. 26, 1991, has been disclaimed.

[22] Filed: Apr. 25, 1975

[21] Appl. No.: 571,524

[52] U.S. Cl. ..... 81/170; 81/186

[51] Int. Cl.[2] ..... B25B 13/16

[58] Field of Search ..... 81/119, 170

[56] References Cited

UNITED STATES PATENTS

| | | | |
|---|---|---|---|
| 3,757,614 | 9/1973 | Evans et al. | 81/119 |
| 3,850,057 | 11/1974 | Evans | 81/119 |
| 3,881,377 | 5/1975 | Evans et al. | 81/119 X |

*Primary Examiner*—Al Lawrence Smith
*Assistant Examiner*—James G. Smith
*Attorney, Agent, or Firm*—Head, Johnson & Chafin

[57] ABSTRACT

An adjustable wrench for torqueing and ratcheting a symmetrical convex polygon member, such as a square, hexagon, or octagon, the wrench having a body with a fixed jaw and a movable jaw, one of the jaws having a torqueing are defined by intersecting torqueing surfaces which engage the planar surfaces on the member to be rotated and having also, outwardly from such torqueing surfaces, a first and second ratcheting surface for engaging adjacent surfaces on the member to be rotated, the outermost ratcheting surface being of a length less than 1/2 the length of the one side of the member to be ratcheted, and the other jaw having a member engaging area including torqueing surface corresponding to the torqueing surfaces of the first mentioned jaw and having a planar outer ratcheting surface which is parallel with the outermost ratcheting surface of the other jaw, such that the spacing between the jaws may be adjusted so that the member may be engaged between the torqueing surfaces of the two jaws for applying torque to the member and may be engaged in a ratcheting relationship by the ratcheting surfaces on the outer end of the jaws so that by repeated reciprocal motion of the wrench body, the member may be ratcheted without removing contact of the wrench from the member.

5 Claims, 7 Drawing Figures

ADJUSTABLE WRENCH FOR TORQUEING AND RATCHETING A SYMMETRICAL POLYGON MEMBER

BACKGROUND, SUMMARY AND OBJECTS OF THE INVENTION

Many types of wrenches have been provided for rotating polygon shaped members, such as squares, hexagons and octagons. These members are usually in the form of bolts, or nuts. The existing wrenches include adjustable jaw wrenches so that various size members may be rotated. In addition, wrenches have been provided for torqueing members, that is, imparting a high degree of torque to the member by rotation of the wrench after it has engaged the member. In addition, wrenches have been provided for ratcheting a member, that is, engaging the member in such a way that by reciprocation of the wrench on the surfaces of the member the member may be rotated without removing contact of the wrench from the member. The present invention is directed towards an adjustable wrench which will accomplish both purposes, that is, a wrench which will adjust to engage a polygon member to apply torque to it in either direction, and, without changing the setting of the wrench, can be employed to ratchet the member, that is, rotate it without removing contact of the wrench from the member.

It is therefore an object of this invention to provide an improved adjustable wrench for both torqueing and ratcheting a polygon member.

More particularly, an object of this invention is to provide a wrench having one jaw movable relative to the other and having the jaw faces configured such that an area in each jaw is provided for securely engaging a member to apply torque to the member in either direction, and having an area on the outer end of each jaw such that the polygon member may be ratcheted without removing contact of the wrench from the member.

These general objects, as well as other and more specific objects of the invention, will be fulfilled in the following description and claims, taken in conjunction with the attached drawings.

DESCRIPTION OF VIEWS

DETAILED DESCRIPTION

Figure 1:
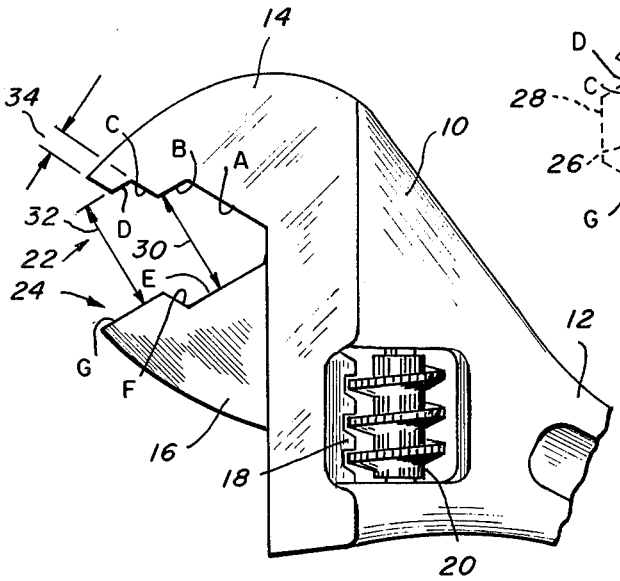
FIG. 1 is a view of an adjustable wrench embodying the principles of this invention showing representative dimensions between opposed surfaces of the wrench jaws.

Referring to the drawings and first to FIG. 1, a wrench embodying the invention is shown. The wrench includes a body 10 having a handle portion 12, the handle portion being broken off. The body 10 includes a fixed jaw 14 and a movable jaw 16. While the invention is not related to the means whereby the movable jaw 16 is adjustably positionable relative to the fixed jaw 14, the example illustrated is a common type of adjustable wrench in which the movable jaw 16 includes a threaded portion 18 and the wrench body 10 includes a rotatably supported knurled threaded nut 20. By rotation of the nut 20 the movable jaw 16 may be moved relative to the fixed jaw 14 and may be adjusted to engage various sizes of members.

Figure 2:
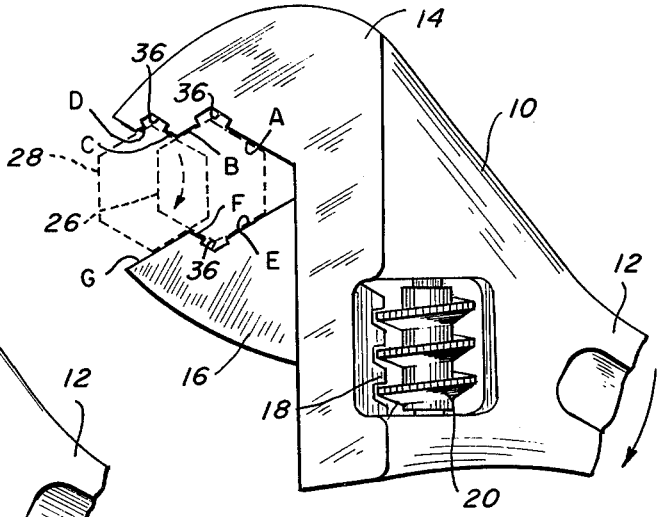
FIG. 2 is a view of a wrench as shown in FIG. 1 showing hexagonal members positioned in the wrench, one of the members being in position for torqueing by the wrench and the other for ratcheting.

The fixed jaw 14 has a member engaging face, generally indicated by the numeral 22 and opposite it is a member engaging face generally indicated by the numeral 24 of the movable jaw 16. The member engaging face 22 includes a first torqueing surface A adjacent the wrench body 10. A second torqueing surface B intersects the first torqueing surface A at an angle which is the same as the angle of intersection of adjacent sides of the polygon for which the wrench is designed. When the wrench is designed to engage a hexagonal member, as shown in FIG. 2, the angle is 120°, when designed to engage an octagonal member the angle is 135°, and when designed to engage square member the angle is 90°. This relationship will be described in more detail subsequently.

The member engaging face 22 of the movable jaw is further defined by a first ratcheting surface C which intersects the surface B at a noncritical angle. A second ratcheting surface D intersects the first ratcheting surface C at the same angle of intersection of the sides of the member to which the wrench is adapted.

The member engaging face 24 of the movable jaw 16 is defined by a first torqueing surface E adjacent wrench body 10, the surface E being parallel to the second torqueing surface B. The movable jaw member engaging face 24 is further defined by a second torqueing surface F intersecting surface E at an angle which is the same as the intersection of surfaces A and B. The next surface of the movable jaw 16 is a ratcheting surface which intersects the second torqueing surface F, the ratcheting surface G being parallel to the surface D of face 22.

Figure 6:
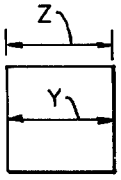
FIG. 6 shows a square member with representative dimensions.
Figure 7:
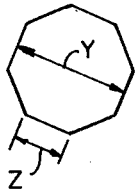
FIG. 7 shows an octagonal member with representative dimensions.
Figure 5:
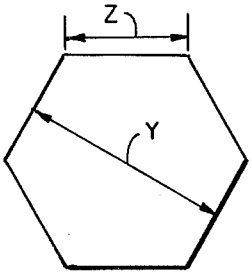
FIG. 5 shows a hexagonal member with representing dimensions.

When the wrench is to be used on a member, it is adjusted so that the space 30 between surfaces B and C which is always the same as space 32 between surfaces D and G, is just slightly greater than the distance Y (See FIGS. 5, 6 and 7), between opposing planar surfaces of the member to be rotated. The wrench is so designed that regardless of the spacing between the jaws the distances between surfaces A and F, B and E, and D and G, remain the same.

FIG. 2 shows the wrench configured to engage a hexagonal member. The angle between intersecting surfaces A-B, E-F, and C-D is 120°. A first hexagonal member 26 can be slidably engaged between the surfaces A, B, E and F. The wrench can then be used to apply torque in either direction to the hexagonal member 28. When it is desired to ratchet the member it is engaged by surfaces C, D and G as shown. In this mode, when the wrench is rotated in the direction indicated by the arrow, 28 is rotated in the direction of the arrow. When the wrench handle is rotated in the opposite direction, no torque is applied to member 28. Thus, the outer surfaces C, D and G are used to ratchet the member while the inner surfaces A, B, E and F are used to torque the member, all without changing the setting of the wrench.

The length, indicated by numeral 34, of the second ratcheting surface D, (see FIG. 1) must always be less than one-half of the length alone one side Z (FIG. 5) of the member to be rotated.

Figure 3:
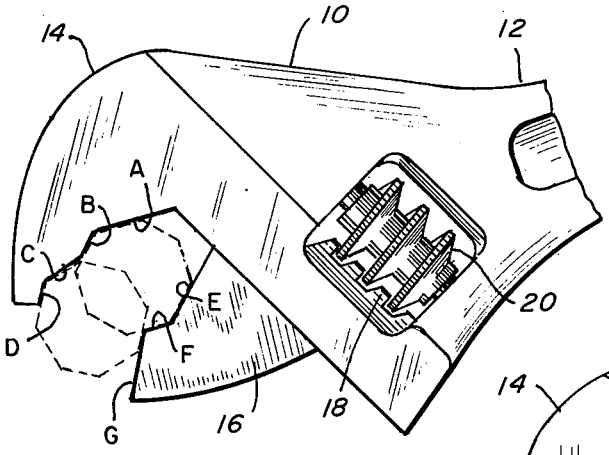
FIG. 3 shows the wrench of FIGS. 1 and 2 as the same would be employed for torqueing or ratcheting an ocatagonal member.

FIG. 3 shows the wrench as configured to engage an octagonal member in which case the angle between surfaces A-B, E-F, and C-D is 135°. An octagonal member 38 is positioned for torqueing and a member 40 for ratcheting. The wrench otherwise functions the same as described relative to the hexagonal configured wrench of FIGS. 1 and 2.

Figure 4:
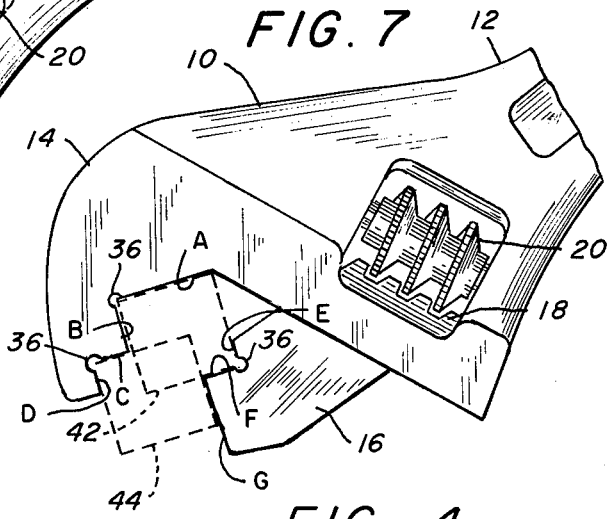
FIG. 4 shows the wrench of this invention configured for torqueing or ratcheting a square member.

FIG. 4 shows the embodiment of the wrench for torqueing and ratcheting a square member in which the angles of intersecting surfaces A-B, E-F and C-D is 90°. Square member 42 is positioned for torqueing and member 44 for ratcheting.

FIG. 2 shows notches 36 of the intersection of surfaces A-B, C-D and E-F. FIG. 4 shows the same arrangement in which the notches 36 are semi-circular. Notches 36 make it easier for members to be received by the wrench, especially members which have irregularities in their surfaces.

As previously indicated, others have devised wrenches for torqueing a member and for ratcheting a member. This invention is directed toward the unique arrangement of an adjustable wrench, which while using the same jaws, can be adjusted so that with one setting, a polygon shaped member may be torqued in either direction or ratcheted.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An adjustable wrench for torqueing and ratcheting a symmetrical convex polygon member, such as a square, hexagon, octagon or the like, where the angle of intersecting sides is X, and the length along a side is Z, comprising:

a wrench body having a fixed jaw extending therefrom and a handle; and a movable jaw movably supported to said wrench body opposite to said fixed jaw, the fixed jaw and movable jaw each having a member engaging face opposed to the other, one jaw face being defined by:

1. a first torqueing surface A adjacent said wrench body;
2. a second torqueing surface B intersecting said surface A at an angle of X;
3. a first ratcheting surface C intersecting said surface B; and
4. a second ratcheting surface D intersecting said surface C at an angle of X, the length of surface D being less than ½ Z;

the face of the other jaw being defined by:

1. a first torqueing surface E adjacent said wrench body and parallel to said surface B;
2. a second torqueing surface F intersecting surface E at an angle of X and being parallel surface A; and
3. a ratcheting surface G intersecting said surface F and being parallel surface D.

2. A wrench according to claim 1 in which, for any selected spacing between said jaw faces the perpendicular distance between surfaces B and E is the same as between surfaces D and G.

3. A wrench according to claim 1 including a notch recess at the intersection of surfaces A and B.

4. A wrench according to claim 1 including a notch recess at the intersection of surfaces C and D.

5. A wrench according to claim 1 including a notch recess at the intersection of surfaces E and F.

* * * * *